US008851462B2

(12) United States Patent
Liu

(10) Patent No.: US 8,851,462 B2
(45) Date of Patent: Oct. 7, 2014

(54) LEVEL ADJUSTING DEVICE FOR WORKTABLE OF JOINTER/PLANAR MACHINE

(76) Inventor: James Liu, Taichung (TW)

( * ) Notice: Subject to any disclaimer, the term of this patent is extended or adjusted under 35 U.S.C. 154(b) by 935 days.

(21) Appl. No.: 13/007,734

(22) Filed: Jan. 17, 2011

(65) Prior Publication Data

US 2012/0180907 A1 Jul. 19, 2012

(51) Int. Cl.
*B27C 1/14* (2006.01)
*B27C 1/02* (2006.01)

(52) U.S. Cl.
CPC .... *B27C 1/14* (2013.01); *B27C 1/02* (2013.01)
USPC ..... 269/289 R; 144/253.8; 411/277

(58) Field of Classification Search
CPC ..... B27C 1/14
USPC ..... 269/289 R; 144/129, 253.8, 287; 411/81–189, 277
See application file for complete search history.

(56) References Cited

U.S. PATENT DOCUMENTS

| | | | | | |
|---|---|---|---|---|---|
| 2,872,957 | A * | 2/1959 | Eschenburg | 144/253.8 |
| 3,003,533 | A * | 10/1961 | Hubbard | 411/277 |
| 3,056,443 | A * | 10/1962 | Knocke | 411/186 |
| 3,171,454 | A * | 3/1965 | Boice | 144/129 |
| 3,391,721 | A * | 7/1968 | Rosan | 411/277 |
| 3,498,353 | A * | 3/1970 | Barry | 411/180 |
| 3,702,087 | A * | 11/1972 | Schmitt | 411/362 |
| 4,447,183 | A * | 5/1984 | Yunt | 411/80.5 |
| 4,597,154 | A * | 7/1986 | Harbour et al. | 29/525 |
| 5,131,795 | A * | 7/1992 | Kobusch | 411/178 |
| 5,143,128 | A * | 9/1992 | Chen | 144/117.1 |
| 5,979,521 | A * | 11/1999 | Garcia | 144/129 |
| 6,176,768 | B1 * | 1/2001 | Juang | 451/302 |
| 6,390,425 | B1 * | 5/2002 | Juang | 248/188.2 |
| 6,494,239 | B1 * | 12/2002 | Liao | 144/129 |
| 6,513,557 | B1 * | 2/2003 | Chuang | 144/129 |
| 7,246,977 | B1 * | 7/2007 | Chuang | 409/344 |
| 7,328,732 | B2 * | 2/2008 | Chuang | 144/253.8 |
| 7,503,358 | B2 * | 3/2009 | Chuang | 144/114.1 |
| 7,721,458 | B2 * | 5/2010 | Liu | 33/635 |
| 2007/0017600 | A1 * | 1/2007 | Kahl | 144/286.1 |
| 2007/0079901 | A1 * | 4/2007 | Chuang | 144/253.8 |
| 2008/0063485 | A1 * | 3/2008 | Chuang | 409/338 |
| 2010/0294399 | A1 * | 11/2010 | Chuang | 144/286.5 |

OTHER PUBLICATIONS

Chinese Utility Model Pat. No. CN 200995413Y, Dec. 26, 2007, 10 pages.

* cited by examiner

*Primary Examiner* — Lee D Wilson
*Assistant Examiner* — Tyrone V Hall, Jr.
(74) *Attorney, Agent, or Firm* — Alan Kamrath; Kamrath IP Lawfirm, P.A.

(57) ABSTRACT

A woodworking machine includes a base, an adjusting device, and an adjustable worktable. The adjusting device is engaged with the base and includes a platform, a plurality of adjusters, and a plurality of fastening members. The platform is slidably engaged with the base. The plurality of adjusters are adjustable, and the plurality of fastening members are releasably inserted through the plurality of adjustors respectively. The adjustable worktable is engaged with the adjusting device. Moreover, the platform bears the adjustable worktable and the plurality of adjusters are abutted against the adjustable worktable. Additionally, the adjustable worktable is adjustably moved upon adjusting of the adjustors, and prior to adjusting each adjustor, the fastening member engaged therewith is removed.

17 Claims, 20 Drawing Sheets

LEVEL ADJUSTING DEVICE FOR WORKTABLE OF JOINTER/PLANAR MACHINE

BACKGROUND OF THE INVENTION

1. Field of the Invention

The present invention relates to an adjusting device and, in particular, to an adjusting device used for a level adjustment of worktable(s) of a jointer/planar machine.

2. Description of the Related Art

U.S. Pat. No. 7,721,458 discloses the teaching as to a level adjusting device for a cutter of a jointer/planar machine of the applicant of the instant application. According to the disclosure, the level adjusting device includes a front support frame having a front seat wall for supporting a front anti-friction bearing unit that holds a front journal segment of a cutter head, and a rear support frame spaced apart from the front support frame. The rear support frame includes left and right base abutments facing upwardly. A height-adjustable carrier has an insertion bore for receiving a rear anti-friction bearing member that holds a rear journal segment of the cutter head. Left and right lugs are disposed outboard of the height-adjustable carrier, and respectively have inner tubular threaded surfaces. Left and right adjusting screws respectively have threaded segments that are engaged threadly and respectively with the inner tubular threaded surfaces of the lugs, and abutting ends configured to be in frictional engagement with the base abutments, respectively. The abutting end of each adjusting screw is turnable about a revolving axis in the upright direction such that the respective lug is moved relative to the adjusting screw so as to raise or lower the carrier, thereby enabling a level adjustment of the cutter head.

Furthermore, China Pat. No. 200995413 shows a planar including a base, and a cutting mechanism disposed on the center of the top of the base. The cutting mechanism includes worktables disposed aside. The worktables include a first worktable that is integrally formed with the base, and a second worktable that is moveable. Further, a slide is disposed between the base and the second worktable and includes a lifting mechanism disposed thereon. Further, two pairs of adjusting screws are symmetrically disposed on the slide, and a pressing member is disposed on each pair of the adjusting screws. Additionally, the second worktable includes two elongated members disposed on the bottom thereof and abutting against the two pressing members, respectively. Moreover, the second worktable is to be adjusted to be level with the first worktable such that the first and second worktables cooperate to form a level surface, and in addition, by adjusting the adjusting screws the pressing members are adapted to be moved which results in the movement of the second worktable.

However, it is still desirable to utilize a level adjusting device for an accurate level adjustment of worktable(s).

The present invention is, therefore, intended to obviate or at least alleviate the problems encountered in the prior art.

SUMMARY OF THE INVENTION

According to the present invention, a woodworking machine includes a base, an adjusting device, and an adjustable worktable. The adjusting device is engaged with the base and includes a platform, a plurality of adjusters, and a plurality of fastening members. The platform is slidably engaged with the base. The plurality of adjusters are adjustable, and the plurality of fastening members are releasably inserted through the plurality of adjustors respectively. The adjustable worktable is engaged with the adjusting device and includes a plurality of receptacles defined therein and a plurality of retaining structures disposed therein. Moreover, the platform bears the adjustable worktable and the plurality of adjusters are abutted against the adjustable worktable. Additionally, the adjustable worktable is adjustably moved upon adjusting of the adjustors, and prior to adjusting each adjustor, the fastening member engaged therewith is removed.

Other objects, advantages, and new features of the present invention will become apparent from the following detailed description of the invention when considered in conjunction with the accompanied drawings.

DETAILED DESCRIPTION OF THE PREFERRED EMBODIMENTS

Figure 1:
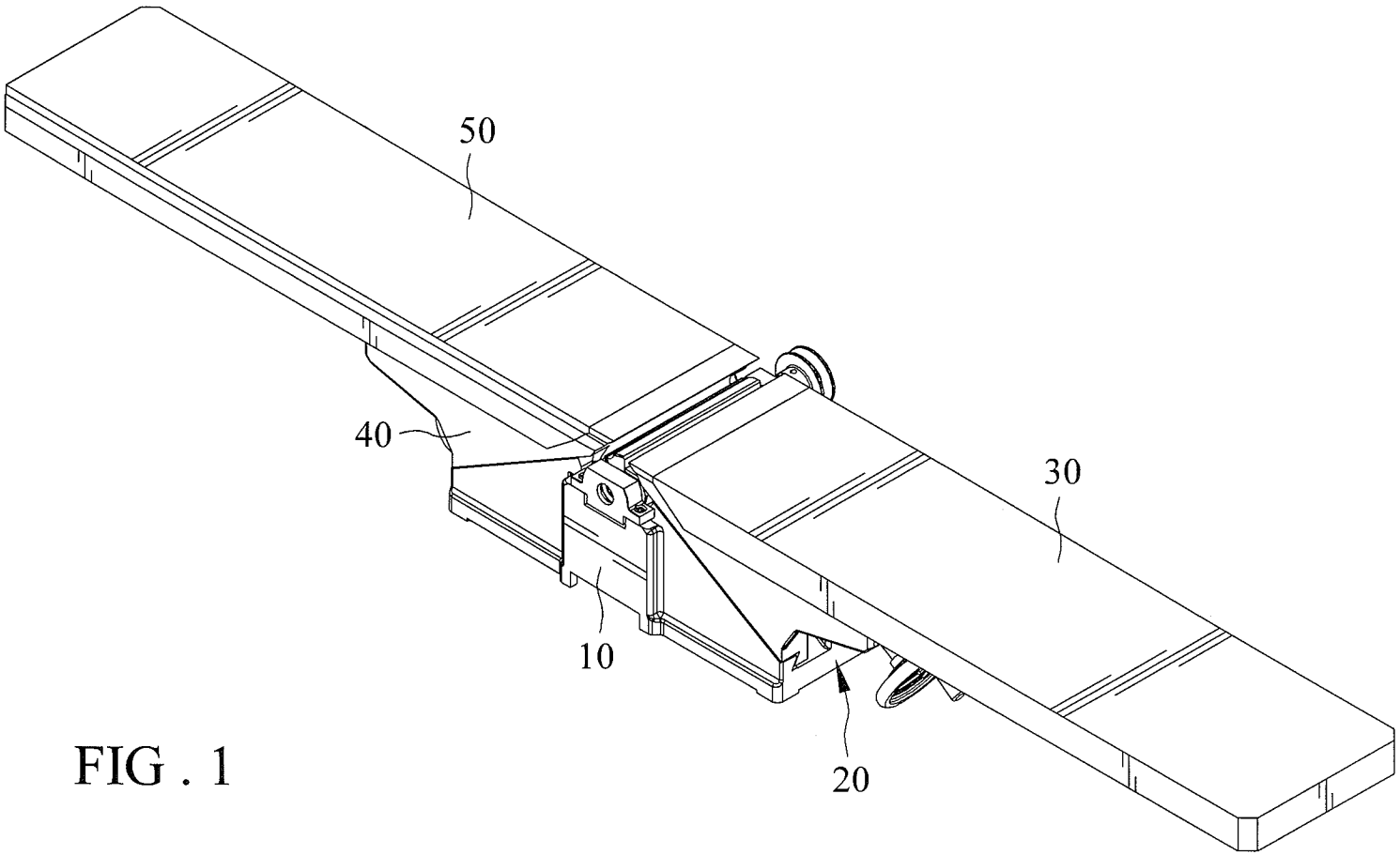
FIG. 1 is a perspective view of a level adjusting device and worktables in accordance with a first embodiment of the present invention.
Figure 2:
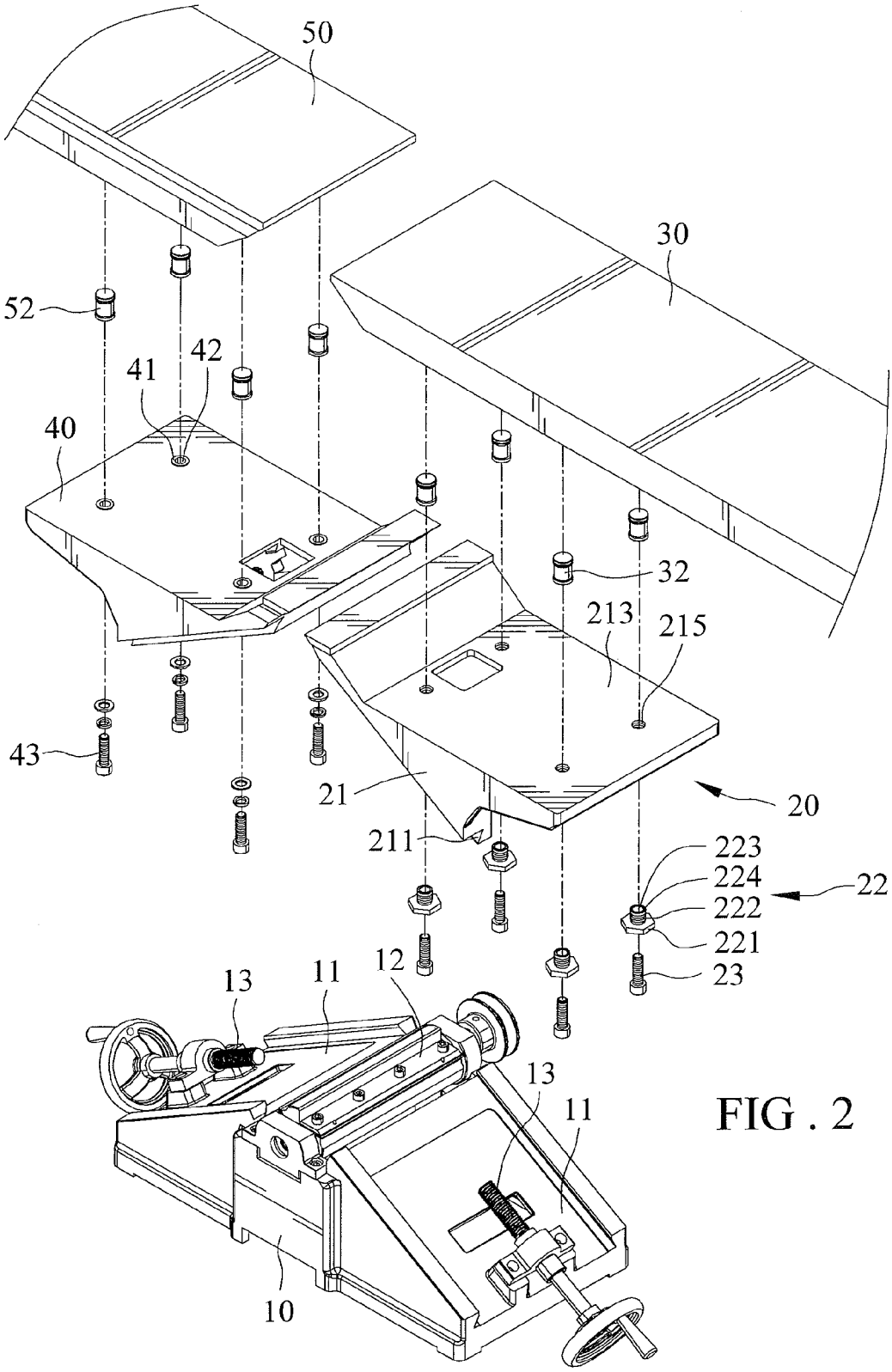
FIG. 2 is an exploded perspective view of the level adjusting device and the worktables of FIG. 1.
Figure 3:
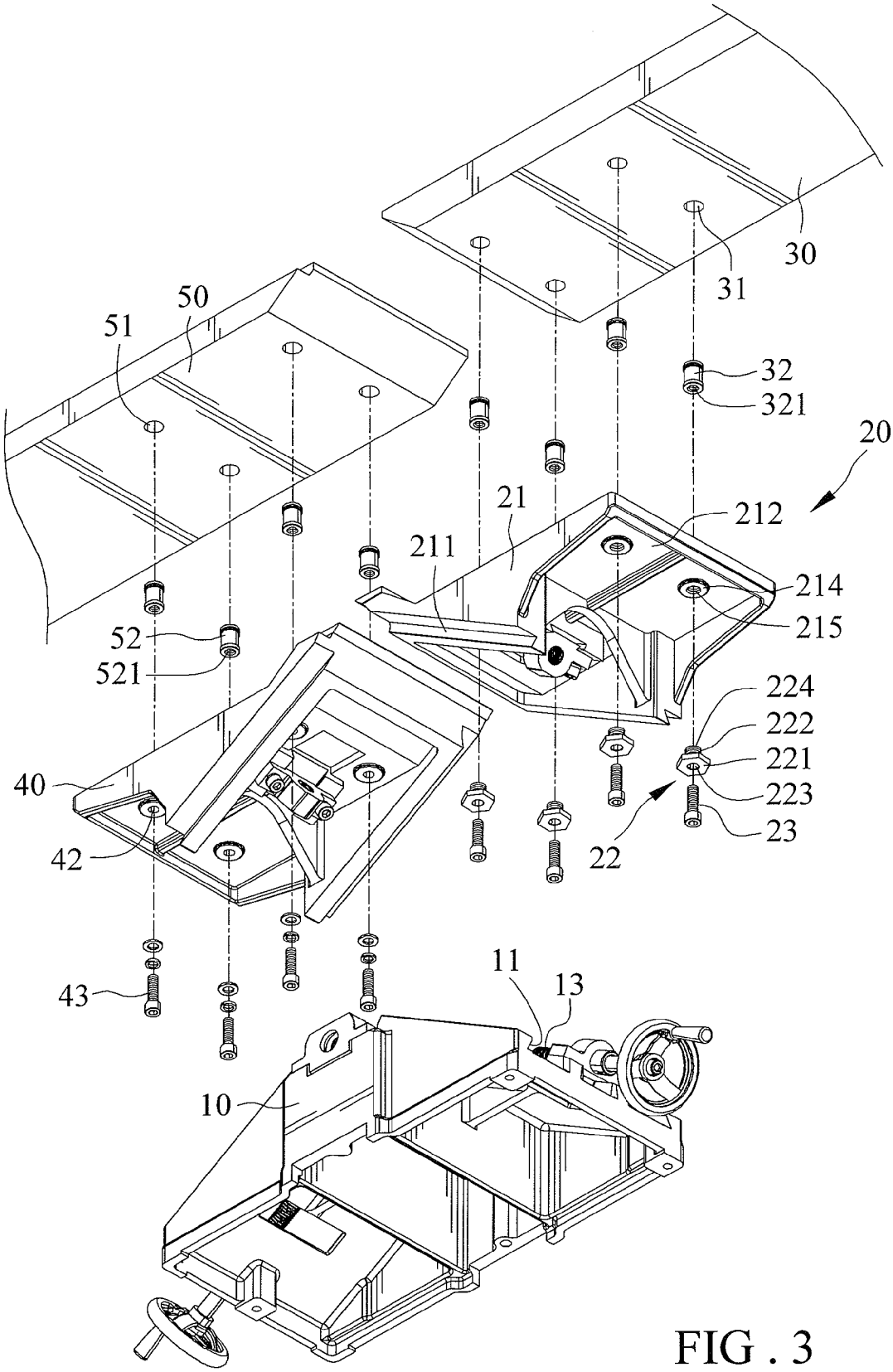
FIG. 3 is another perspective view of the level adjusting device and the worktables of FIG. 1 taken from a different angle of view than that of FIG. 2.
Figure 4:
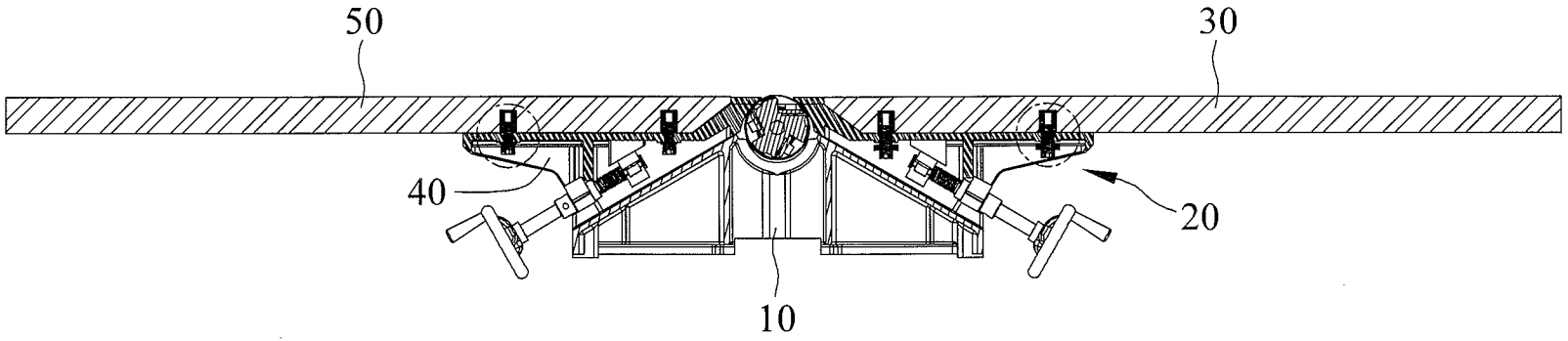
FIG. 4 is a cross-sectional view of the level adjusting device of FIG. 1.
Figure 5:
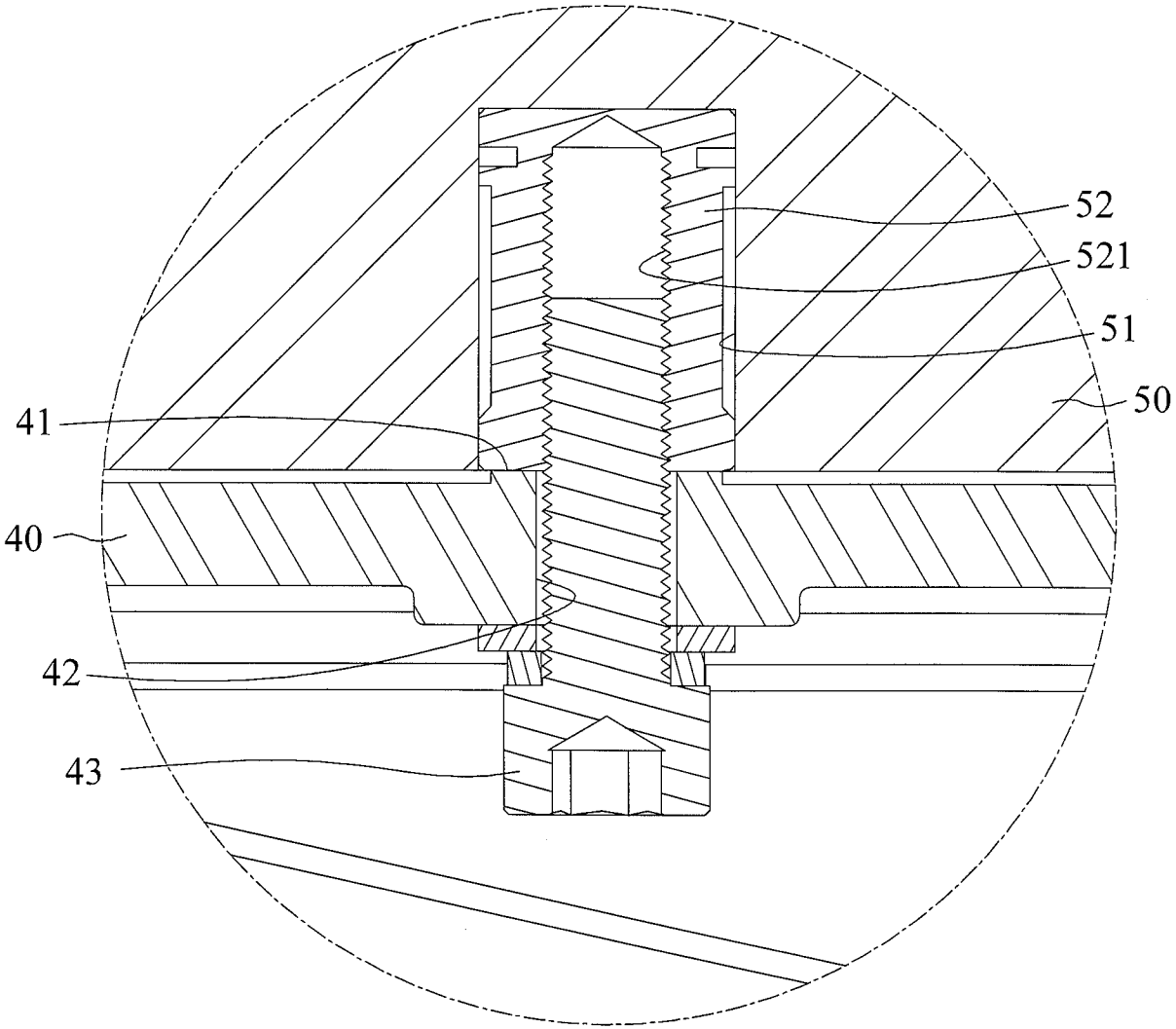
FIG. 5 is a partial, enlarged view of FIG. 4.
Figure 6:
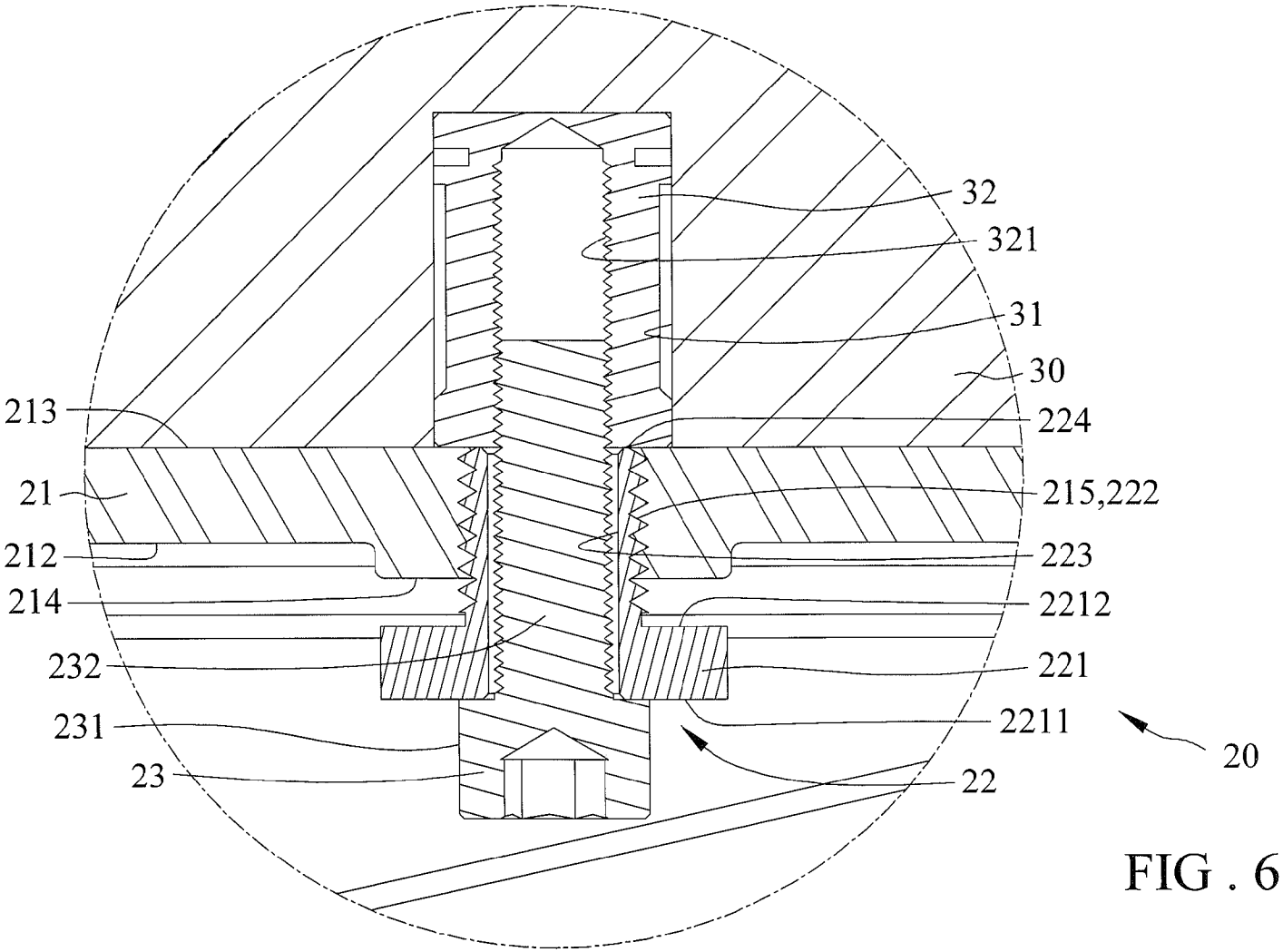
FIG. 6 is another partial, enlarged view of FIG. 4.
Figure 7:
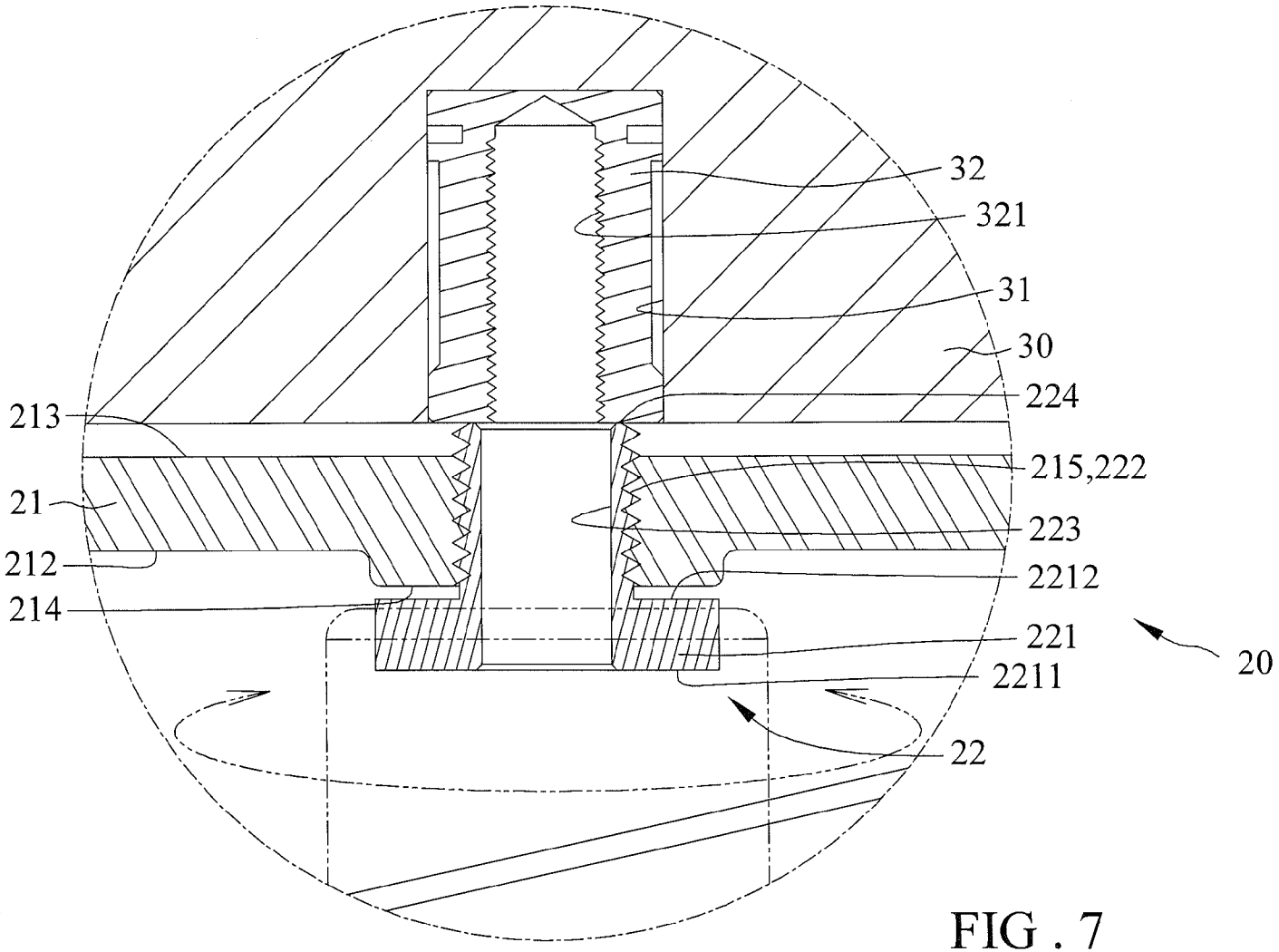
FIG. 7 is a continued cross-sectional view of FIG. 6 and shows the worktable that is to be adjusted undergoing a level adjustment operation and a tool for carrying out the adjustment, with the tool shown in phantom.
Figure 8:
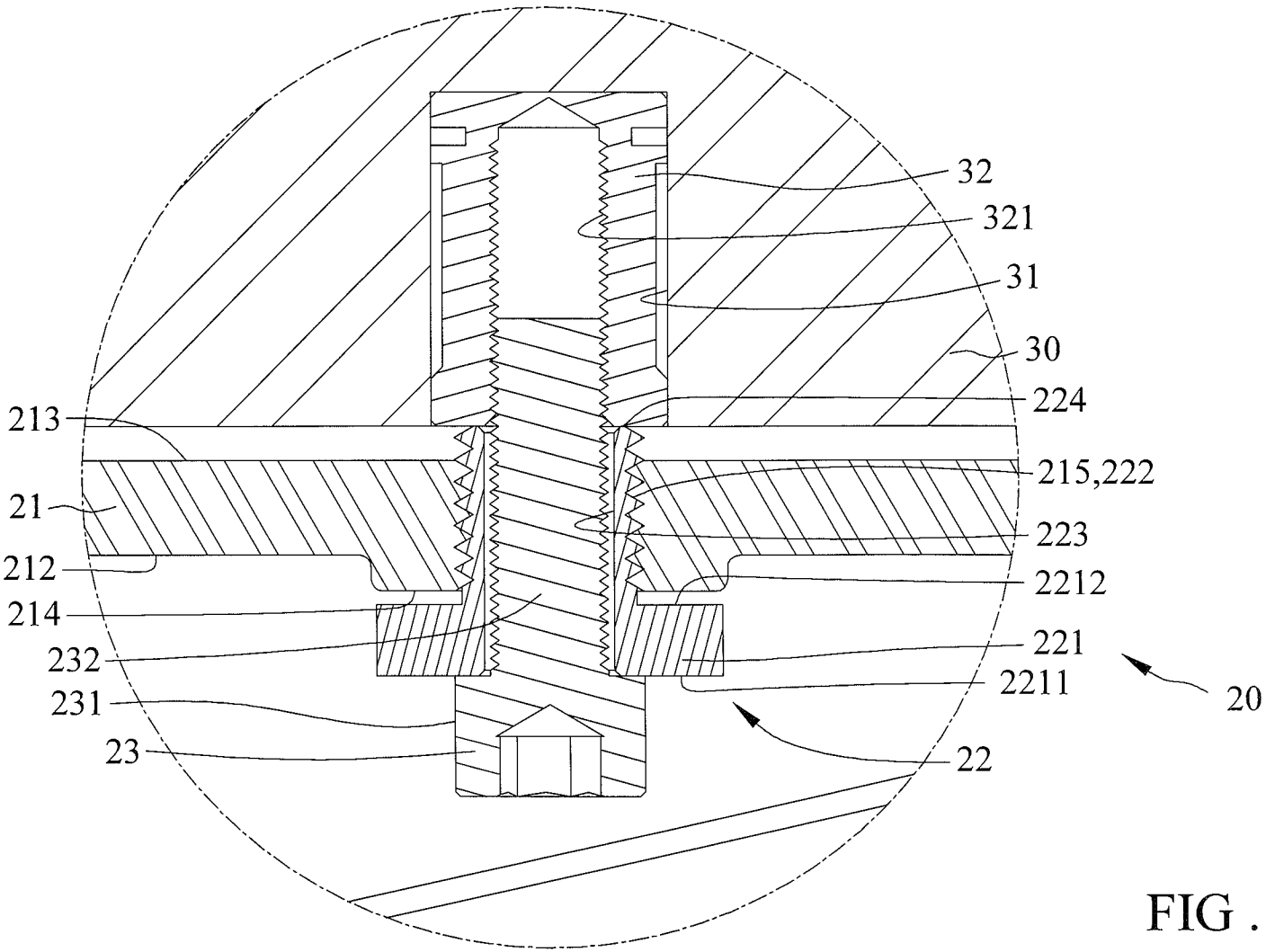
FIG. 8 is a continued cross-sectional view of FIG. 7 and shows the worktable adjusted to another horizontal position different than that of FIG. 6.

FIGS. 1 through 8 show a level adjusting device and worktables in accordance with a first embodiment of the present invention include a base 10, an adjusting device 20, two worktables including an adjustable worktable 30 and a fixed worktable 50, and a fixing device 40.

The base 10 includes two symmetrically disposed slides 11, which form a dovetail channel individually. The base 10 further includes a cutter-mounting body 12 receiving a cutter that is used to plane a workpiece. The cutting-mounting body 12 is interposed between the two slides 11 and is adapted to be adjusted up and down, thereby allowing the cutter to be adjusted up and down. Further, an adjusting mechanism 13 is disposed on each slide 11. The adjusting device 20 is disposed on one slide 11 and engages with the adjustable worktable 30, and in addition, one of two adjusting mechanisms 13 is in connection with the adjusting device 20 and is operated to urge the adjusting device 20 to move relative to the base 10 to cause the adjustable worktable 30 to move up and down. Likewise, the fixing device 40 is disposed on the other slide 11 and engages with the fixed worktable 50, and in addition, the other adjusting mechanism 13 is in connection with the fixing device 40 and is operated to urge the fixing device 40 to move relative to the base 10 to cause the fixed worktable 50 to move to a predetermined horizontal position before being rolled out. In this regard, the adjustable table 30 is adjusted with respect to a horizontal position of the fixed worktable 50 thereafter.

Furthermore, the adjustable worktable 30 and the fixed worktable 50 are made of granite. Additionally, the fixed worktable 50 includes a plurality of receptacles 51 defined in the back thereof and including a smooth inner periphery individually. Note that the inner periphery of each receptacle 51 is not threaded for the fixed worktable 50 is made of granite and it is difficult to fabricate the receptacles 51 with such complicated structures therein. Further, a plurality of retaining structures 52 are inserted in the plurality of receptacles 51, respectively, and each does not extend out of the receptacle 51 engaged therein, and in addition, each includes a hole 521 defined therein, and the hole 521 has a threaded inner periphery.

As set forth, the fixing device 40 is slidably engaged in one slide 11 of the base 10. In addition, the fixing device 40 includes a surface including a plurality of stopping structures 41 extending therefrom and a plurality of bores 42 extending therethrough and coaxially with and through the plurality of stopping structures 41, respectively. Further, a fastener 43 is inserted in and through each bore 42 and is in thread engagement with the hole 521 of each retaining structure 52, namely, the fastener 43 includes a threaded body inserted through the bore 42 and an end of the threaded body is threadly engaged with the hole 521 of the retaining structure 52. Furthermore, each stopping structure 41 is abutted against each retaining structure 52, namely, the stopping structure 41 has a first surface and the retaining structure 52 has a second surface contacting with the first surface. In this regard, the fixing device 40 and the fixed worktable 50 are in a surface contact which allows the fixing surface 40 to bear the fixed worktable 50 stably.

As also set forth, the adjusting device 20 is slidably engaged in one slide 11 of the base 10. In addition, the adjusting device 20 includes a platform 21, a plurality of adjusters 22, and a plurality of fastening members 23. The platform 21 is made of cast iron for better shock absorption and is slidably engaged with the base 10, and in addition, includes an engaging section 211 for engaging with one slide 11 of the base 10, a bottom surface 212, and a top surface 213 opposite to and parallel with the bottom surface 212. The engaging section 211 of the adjusting device 20 is in the form of a dovetail and mutually and movably fits in the slide 11 of the base 10. Further, a plurality of stopping structures 214 extend from the bottom surface 212 and a plurality of apertures 215 extending through the bottom and top surfaces 212 and 213 as well as the plurality of stopping structures 214, respectively. Also, each aperture 215 has a threaded inner periphery. The plurality of adjusters 22 are to be adjusted for urging the adjustable worktable 30. Each adjuster 22 includes a first section 221 to be engaged with a tool for facilitating an adjustment of the adjuster 22, a second section 222 to be adjustably engaged in one of the apertures 215, and a through hole 223 extending through the first and second sections 221 and 222, and in addition, the second section 222 defines a contacting end 224 at a distal end thereof. That is, a wrench is adapted to be used to adjust the relative position of each adjustor 22 in the aperture 215 engaged therewith, with the wrench clutching the first section 221. In the preferred embodiment, the first section 221 of each adjustor 22 is of a hexagonal cross section. Additionally, the second section 222 of each adjustor 22 has a threaded outer periphery in thread engagement with the inner periphery of the aperture 215 engaged therewith. Furthermore, the first section 221 of each adjustor 22 includes two opposing planar sides defining a first planar side 2211 and a second planar side 2212, and the first planar side 2211 defines a distal end of the adjustor 22, and in addition, the second planar side 2212 is an interface of the first and second sections 221 and 222. The plurality of fastening members 23 are to be inserted through the through holes 223 of the plurality of adjustors 22, respectively. Each fastening member 23 includes a first section 231, and a second section 232 extending from the first section 231, and in addition, the first section 231 includes a recess defined therein to be engaged with a tool that facilitates an adjustment of the fastening member 23, and the second section 232 includes a threaded outer periphery.

The adjustable worktable 30 is made of granite. Basically, the granite made worktable 30 has a superior ability to remain flat and to resist against any intrinsic and extrinsic deformation because granite has hardness of 5-7 according to Moh's hardness, which is 8 times higher than steel, and 2.5 times higher than cast steel, and is not susceptible to erosion caused by acid, and can sustain at least the pressure of 2000 thousand gram per square millimeter. In addition, granite is insulated from magnetic forces, and is not sticky to foreign matters, as well as is resistant to intrinsic deformation caused by temperature and humidity changes, and is able to be maintained and cleaned easily. Furthermore, the adjustable worktable 30 includes a plurality of receptacles 31 defined in the back thereof, and a plurality of retaining structures 32 inserted in the plurality of receptacles 31, respectively. Each retaining structure 32 does not extend out of the receptacle 31 engaged therein and includes a hole 321 defined therein, and the hole 321 includes a threaded inner periphery. Moreover, the adjustable worktable 30 is abutted against the top surface 213 of the platform 21, with the holes 321 of the plurality of the retaining structures 32 aligned with the plurality of apertures 215 in platform 21, respectively, with the contacting end 224 of each adjuster 22 abutted against one retaining structure 32, and with the second sections 232 of the plurality of fastening members 23 inserted through the through holes 223 of the plurality of the adjusters 22 and engaged in the holes 321 of the plurality of the retaining structures 32, respectively. Preferably, the second section 232 of each fastening member 23 is not abutted against an inner periphery of the through holes 223 of each adjuster 22. In the preferred embodiment, the first section 231 of each fastening member 23 is abutted against the first planar side 2211 of the adjustor 22 engaged therewith.

The adjusting device 20 is used to make the adjustable worktable 30 level with the fixed worktable 50. In this regard, the adjustable worktable 30 is adjusted by adjusting the adjustors 22 with respect to the apertures 215 engaged therein, and the adjustable worktable 30 is moved by the adjustors 22. Additionally, prior to adjusting each adjustor 22, the fastening member 23 engaged therewith is removed and disengaged from the retaining structure 32 engaged therewith with a tool that facilitates the removal thereof. After the fastening member 23 is removed, a tool for facilitating an adjustment of the adjustor 22 is engaged with the first section 221 and is operated to drive the adjustor 22 to urge the retaining structure 32 abutted thereagainst, i.e., the contacting end 224 of the adjustor 22 is abutted against the retaining structure 32 as set forth. In this regard, the adjustable worktable 30 is moved as the retaining structures 32 are urged. Furthermore, each fastening member 23 that has been disengaged from the adjustor 22 and the retaining structure 32 engaged therewith during a level adjustment of the adjustable worktable 30 is inserted through the adjustor 22 and retain in the retaining structure 32 engaged therewith previously after the adjustment is finished.

Figure 9:
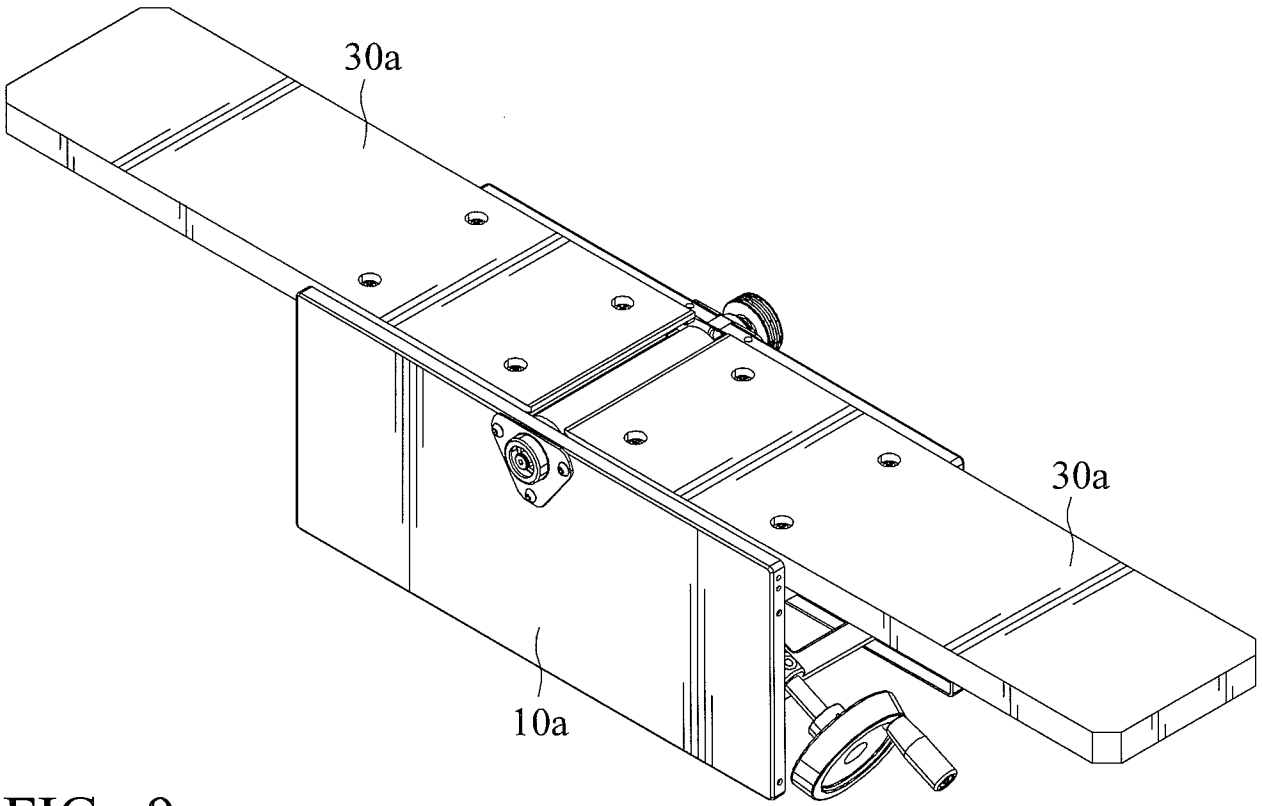
FIG. 9 is a perspective view of a level adjusting device and worktables in accordance with a second embodiment of the present invention.
Figure 10:
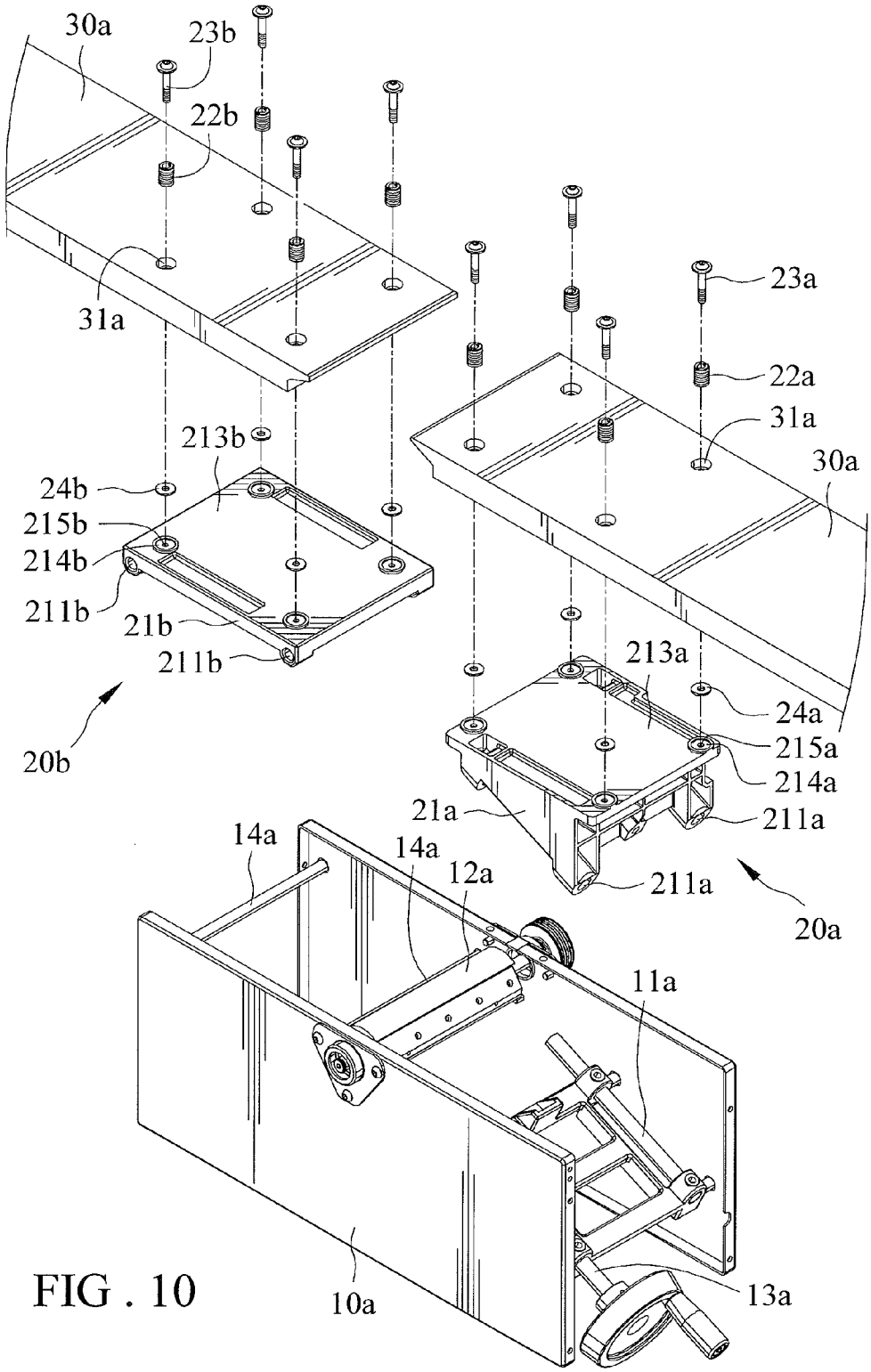
FIG. 10 is an exploded perspective view of the level adjusting device and the worktables of FIG. 9.
Figure 11:
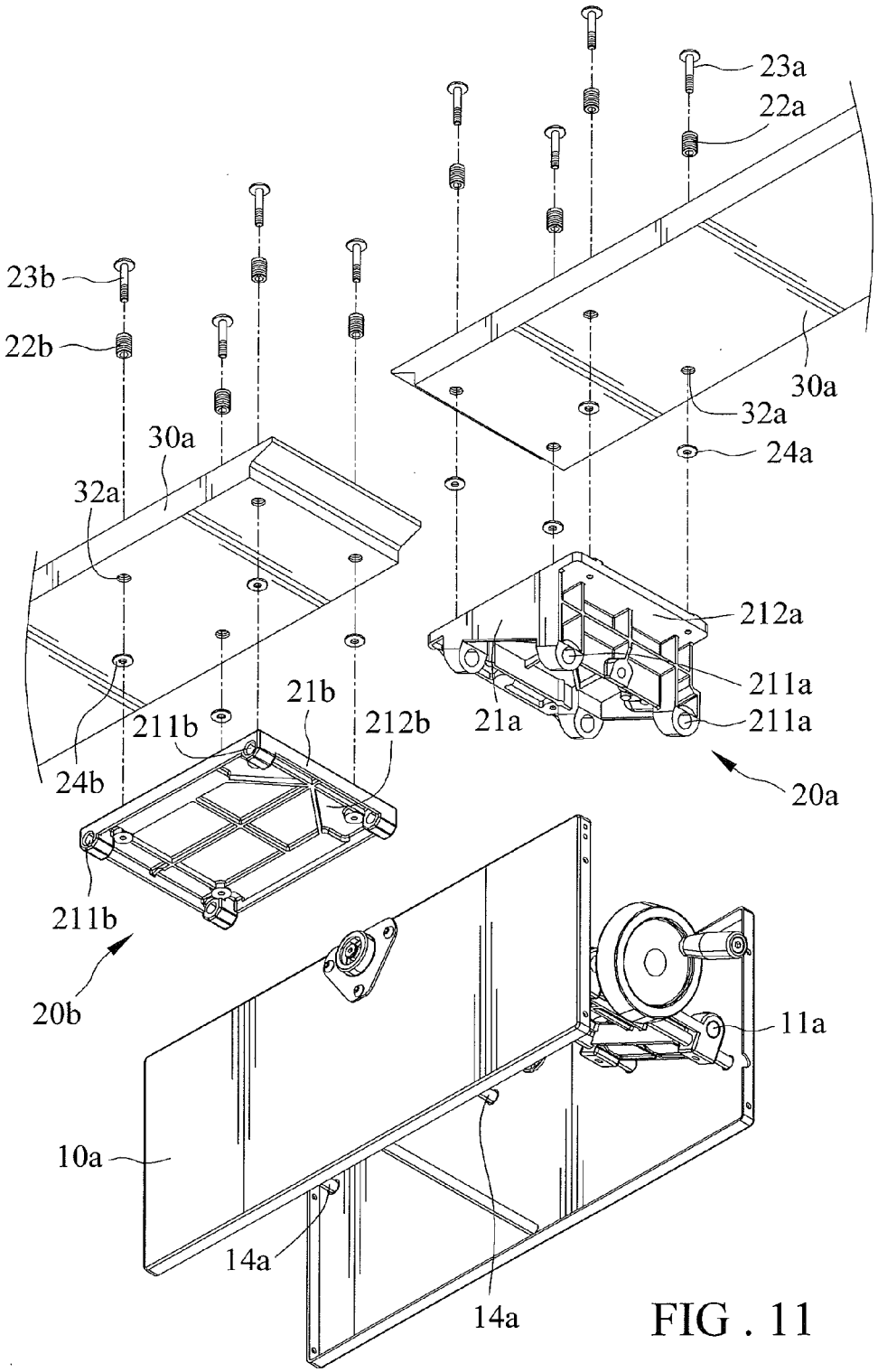
FIG. 11 is another perspective view of the level adjusting device and the worktables of FIG. 9 taken from a different angle of view than that of FIG. 10.
Figure 12:
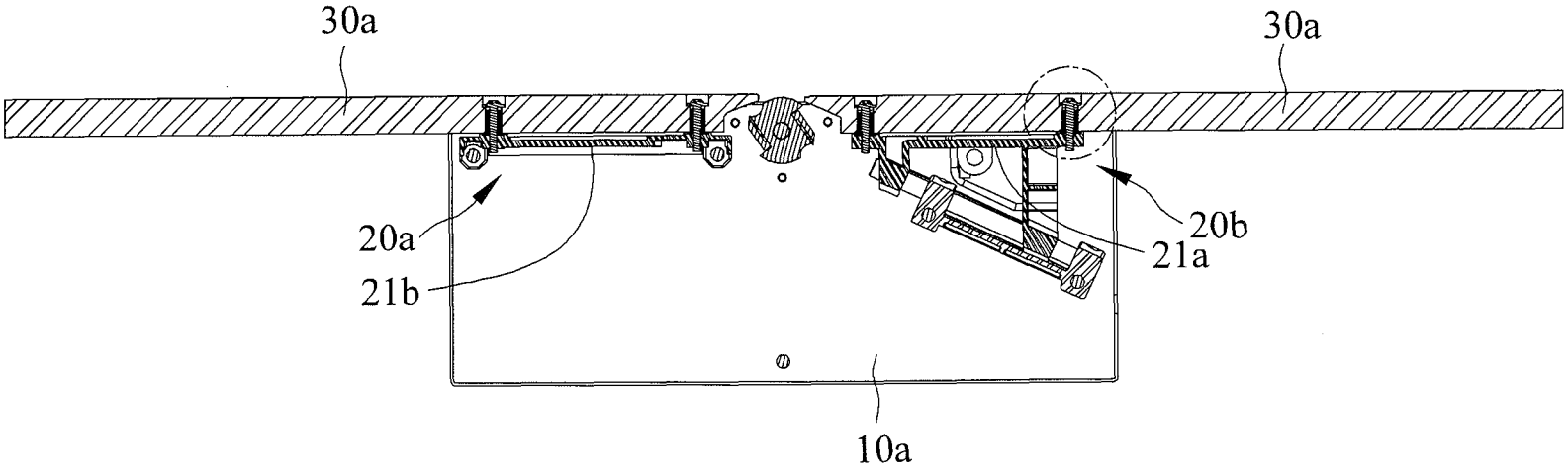
FIG. 12 is a cross-sectional view of the level adjusting device and the worktables of FIG. 9.
Figure 13:
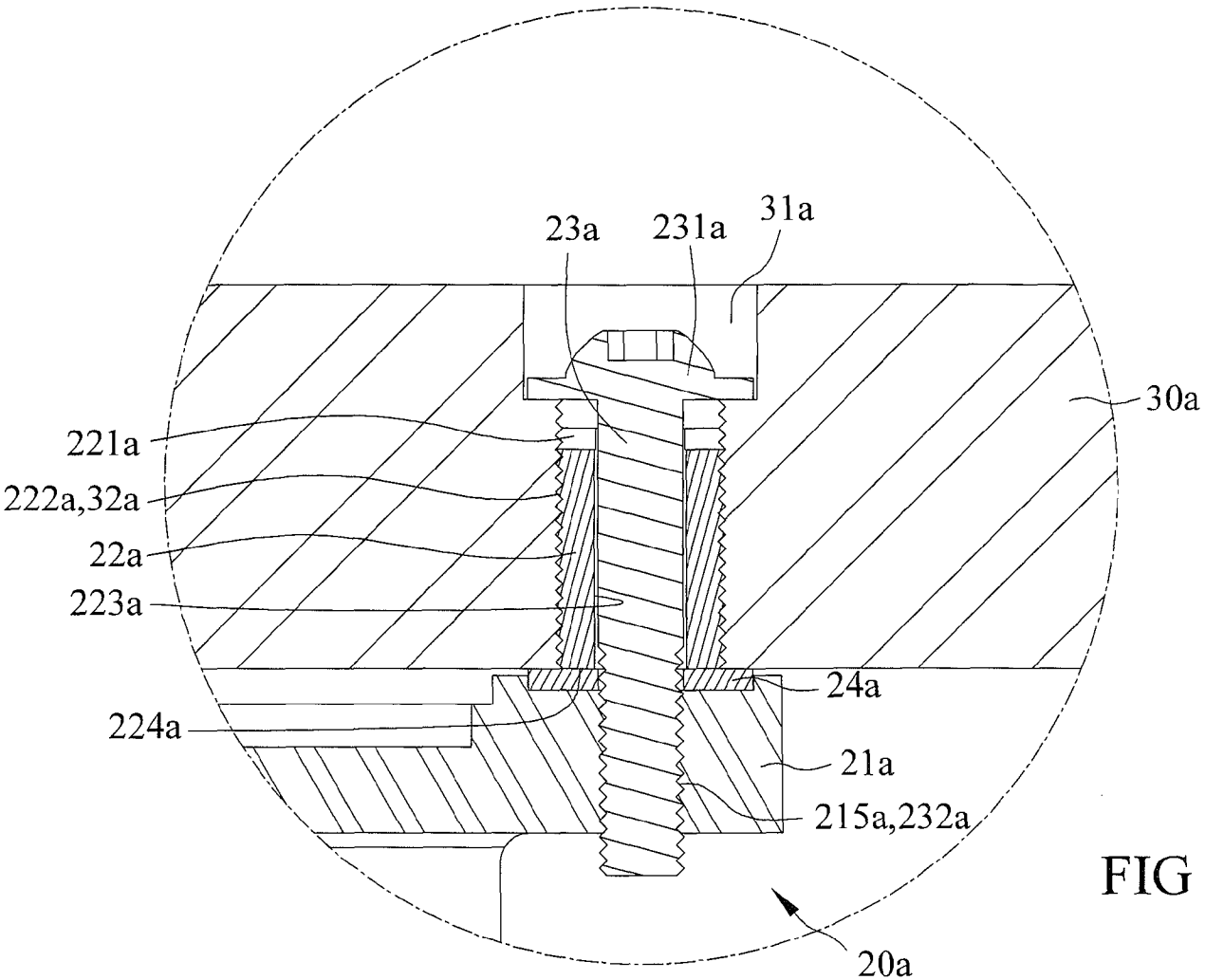
FIG. 13 is a partial, enlarged view of FIG. 12.
Figure 14:
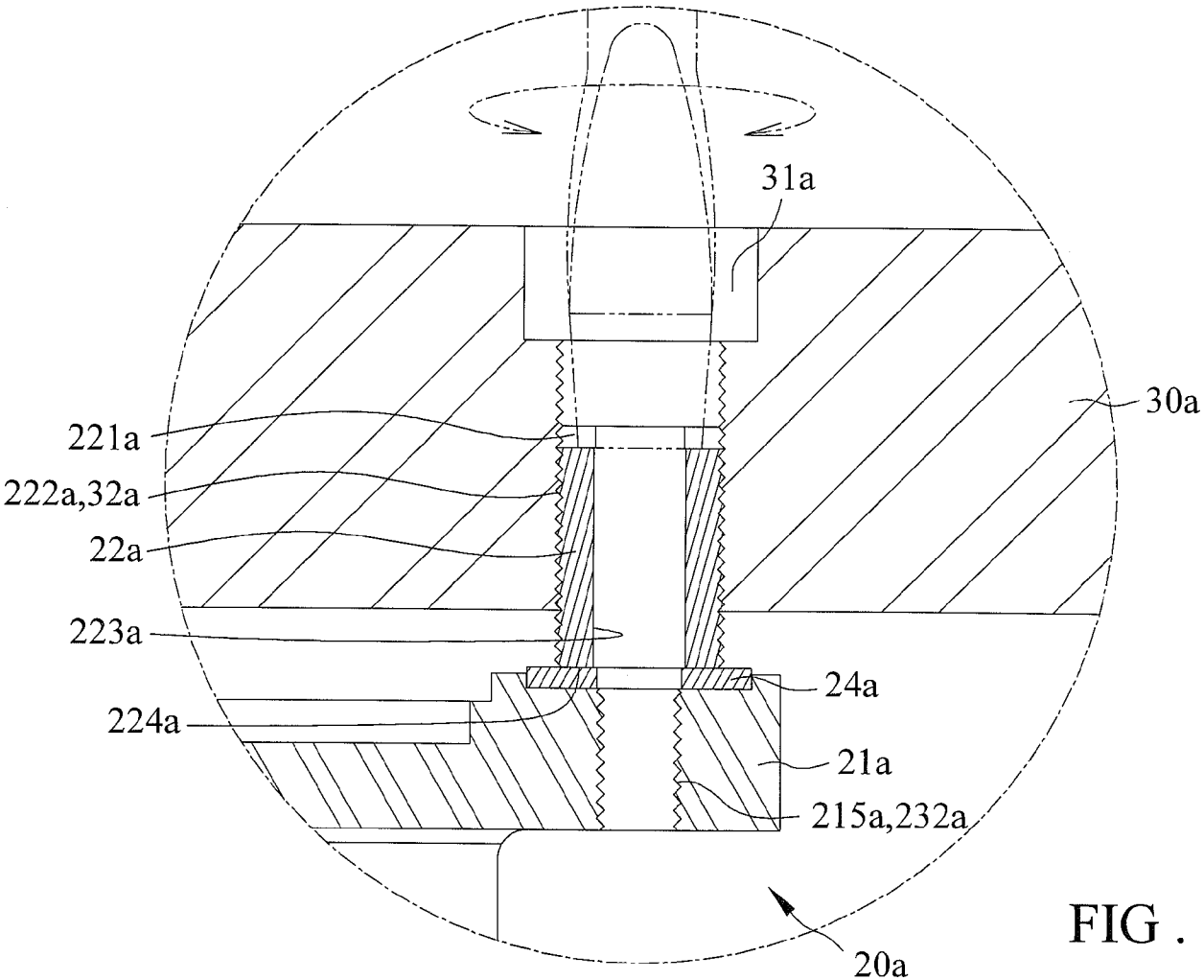
FIG. 14 is a continued cross-sectional view of FIG. 13 and shows the worktable that is to be adjusted undergoing a level adjustment operation and a tool for carrying out the adjustment, with the tool shown in phantom.
Figure 15:
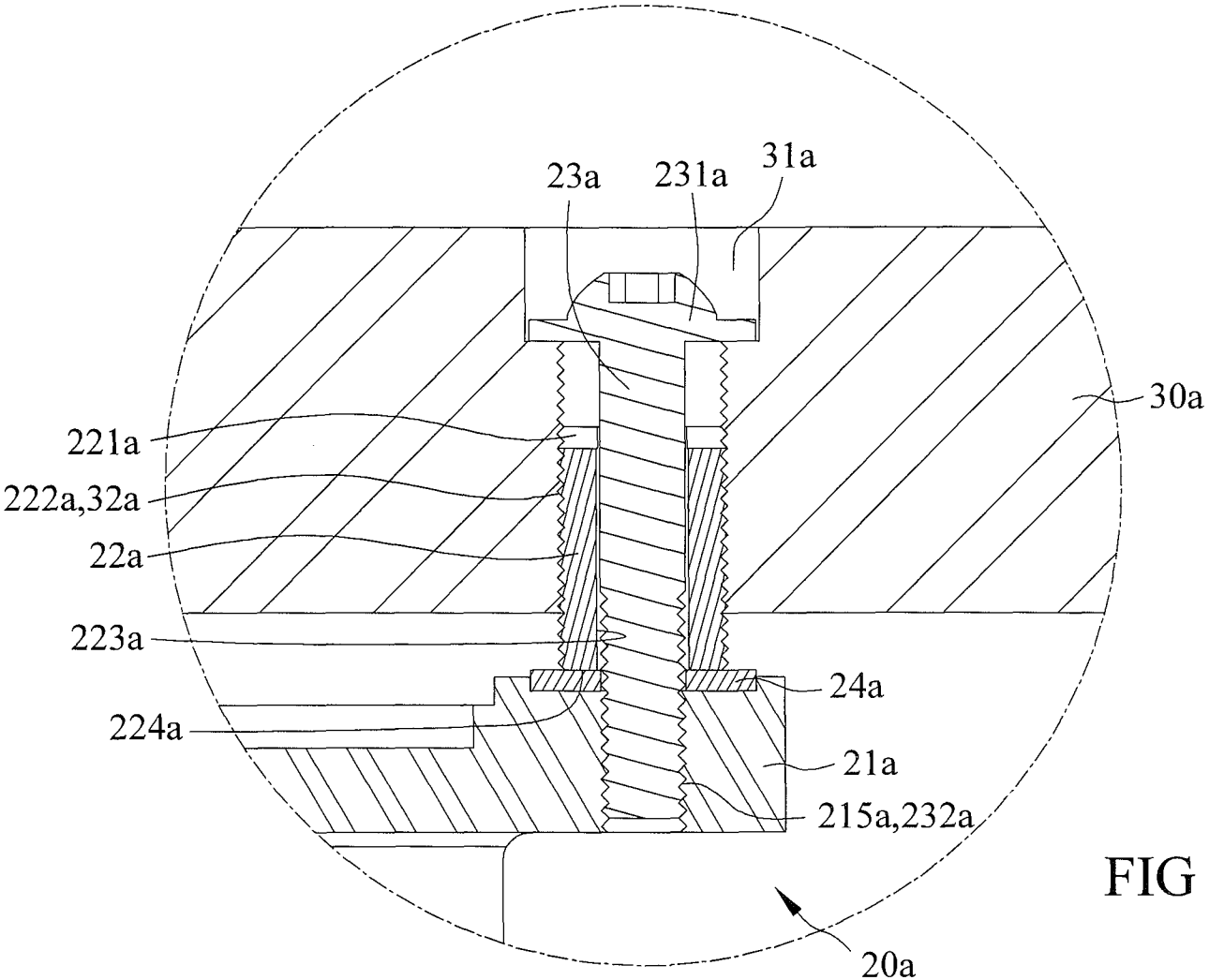
FIG. 15 is a continued cross-sectional view of FIG. 14 and shows the worktable adjusted to another horizontal position different than that of FIG. 13.

FIGS. 9 through 12 show a level adjusting device and worktables in accordance with a second embodiment of the present invention, wherein the same numerals are employed to denote the same parts previously shown and described. The second embodiment includes a base 10*a*, a first adjusting device 20*a*, a second adjusting device 20*b*, and two adjustable worktables 30*a*. The base 10*a* includes two separate panels disposed in a spaced relationship and opposite to each other, that is, a gap is defined between the two panels. The base 10*a* further includes at least one slide 11*a* mounted on the base 10*a*. In the preferred embodiment, the at least one slide 11*a* is mounted between the two panels of the base 10*a* and extends parallel to each panel. Further, a cutter-mounting body 12*a* is mounted on the base 10*a*. In the preferred embodiment, the cuter-mounting body 12*a* is mounted between the two panels of the base 10*a*. Likewise, the cutter-mounting body 12*a* receives a cutter that planes a workpiece. Additionally, the at least one slide 11*a* includes an adjusting mechanism 13*a* to be operated to move the first adjusting device 20*a* that is movably engaged with the slide 10*a*. One of the two adjustable worktables 30*a* is mounted on the first adjusting device 20*a* and is moved up and down upon moving the first adjusting device 20*a* with respect to the base 10*a*. The base 10*a* yet further includes at least one strut 14*a* mounted on the base 10*a* bearing the second adjusting device 20*b*. In the preferred embodiment, the base 10*a* includes two struts 14*a*, which are disposed in a spaced relationship, extending between the two panels of the base 10*a*.

Furthermore, the first adjusting device 20*a* includes a platform 21*a*, a plurality of adjustors 22*a*, a plurality of fastening members 23*a* and a plurality of spacers 24*a*. The platform 21*a* is made of cast iron for better shock absorption and includes at least one engaging section 211*a*, a bottom surface 212*a*, and a top surface 213*a*. The platform 21*a* is engaged with the at least one slide 11*a*, namely, the platform 21*a* includes two engaging sections 211*a* and the at least one slide 11*a* includes two slides 11*a* engaging with the two engaging sections 211*a* of the platform 21*a*, respectively. In the preferred embodiment, each slide 11*a* is in the form of a shaft and has a circular cross section and each engaging section 211*a* is in the form of an orifice and has a circular cross section, so the slide 11*a* is inserted through the engaging section 211*a*. The bottom surface 212*a* and the top surface 213*a* are parallel to each other. Additionally, the top surface 213*a* includes a plurality of stopping structures 214*a* extending therein. Further, a plurality of apertures 215*a* extend in the platform 21*a* and are defined coaxially and in communication with the plurality of the stopping structures 214*a*, respectively. Each aperture 215*a* has a threaded inner periphery. Each adjustor 22*a* includes a first section 221*a*, a second section 222*a* extending from the first section 221*a*, and a through hole 223*a* extending through the first and second sections 221*a* and 222*a*. Additionally, the second section 221*a* of each adjustor 22*a* includes a contacting end 224*a* defined thereon. Furthermore, the first section 221 and the contacting end 224*a* of each adjustor 22*a* are defined on two opposing ends thereof. Each fastening member 23*a* includes a first section 231*a*, and a second section 232*a* extending from the first section 231*a*, and in addition, the first section 231*a* includes a recess defined therein to be engaged with a tool that facilitates an adjustment of the fastening member 23*a*, and the second section 232*a* includes a threaded outer periphery.

In addition, the second adjusting device 20*b* includes a platform 21*b*, a plurality of adjustors 22*b*, a plurality of fastening members 23*b*, and a plurality of spacers 24*b*. The platform 21*b* is made of cast iron for better shock absorption and includes at least one engaging section 211*b*, a bottom surface 212*b*, and a top surface 213*b*. The platform 21*b* is engaged with the at least one strut 14*a*, namely, the platform 21*b* includes two engaging sections 211*b* and the two struts 14*a* as set forth engaging with the two engaging sections 211*b* of the platform 21*b*, respectively, so that the platform 21*b* is connected to the base 10*a*. The bottom surface 212*b* and the top surface 213*b* are parallel to each other. Additionally, the top surface 213*a* includes a plurality of stopping structures 214*b* extending therein. Further, a plurality of apertures 215*a* extend in the platform 21*a* and are defined coaxially and in communication with the plurality of the stopping structures 214*a*, respectively. Each aperture 215*a* has a threaded inner periphery. Each adjustor 22*b* is of the same structure as each adjustor 22*a*. Each fastening member 23*b* is of the structure as each fastening member 23*a*.

The adjustable worktables 30*a* are made of cast iron or aluminum. Each adjustable worktable 30*a* includes a plurality of receptacles 31*a* defined therein. Further, a plurality of retaining structures 32*a* are disposed in each adjustable worktable 30*a*, and each retaining structure 32*a* is in the form of an orifice extending in the adjustable worktable 30*a* and is disposed coaxially with one receptacle 31*a*.

The plurality of adjustors 22*a* are received in one adjustable worktable 30*a* and the plurality of adjustors 22*b* are received in the other adjustable worktable 30*a*, respectively, that is, the plurality of adjustors 22*b* are engaged in the plurality of retaining structures 32*a* of one adjustable worktables 30*a* and the plurality of adjustors 22*b* are engaged in the plurality of retaining structures 32*a* of the other adjustable worktable 30*a*, respectively. Each adjustor 22*a* and 22*b* has a threaded outer periphery. Each retaining structure 32*a* has a threaded inner periphery. In this regard, the outer threaded periphery of each adjustor 22*a* and 22*b* is engaged with the inner periphery of the retaining structure 32*a* engaged therein when the adjustor 22*a* and 22*b* is in thread engagement with the retaining structure 32*a*.

The plurality of fastening members 23*a* are inserted in one adjustable worktable 30*a* as well as the plurality of adjustors 22*a* and engage with the platform 21*a* and the plurality of fastening members 23*b* are inserted in the other adjustable worktable 30*a* as well as the plurality of adjustors 22*b* and engage with the platform 21*b*, respectively, that is, the plurality of fastening members 23*a* are inserted in the plurality of receptacles 31*a* of one adjustable worktable 30*a* and the through holes 223*a* of the plurality of adjustors 22*a*, respectively, with the first section 231*a* of each fastening member 23*a* received in the receptacle 31*a*, with the second section 232*a* of each fastening member 23*a* inserted through the through hole 223*a* and engaging in one aperture 215*a*. Preferably, the second section 232*a* of each fastening member 23*a* is not abutted against an inner periphery of the through hole 223*a* of each adjuster 22*a*.

The plurality of spacers 24*a* are retained on the plurality of stopping structures 214*a*, respectively. Furthermore, each spacer 24*a* is inserted through by one fastening member 23*a*.

The first adjusting device 20*a* is used to make the adjustable worktable 30*a* engaged therewith level with the other adjustable worktable 30*a*. In this regard, the adjustable worktable 30*a* is adjusted by adjusting the adjustors 22*a* with respect to the retaining structures 32*a* engaged therein, and the adjustable worktable 30*a* is moved by the adjustors 22*a*. Additionally, prior to adjusting each adjustor 22*a*, the fastening member 23*a* engaged therewith is removed and disengaged from the aperture 215*a* engaged therein with a tool that facilitates the removal thereof. After the fastening member 23*a* is removed, a tool for facilitating an adjustment of the adjustor 22*a* is engaged with the first section 221*a* and is operated to drive the adjustor 22*a* to urge the adjustable worktable 30 engaged therewith with respect to the platform 21*a*. Furthermore, each fastening member 23*a* that has been disengaged from the adjustor 22*a* and the platform 21*a* engaged therewith during a level adjustment of the adjustable worktable 30*a* engaged therewith is inserted through the adjustor 22*a* and engage with the platform 21*a* engaged therewith previously after the adjustment is finished. Likewise, the adjustable table 30*a* that the second adjusting device 20*b* engaged therewith is adapted to be adjusted with respect to the platform 21*b* through an adjustment of each adjustor 22*b*, and prior to adjusting the adjustor 22*b*, the fastening member 23*b* engaged therewith is removed.

Figure 16:
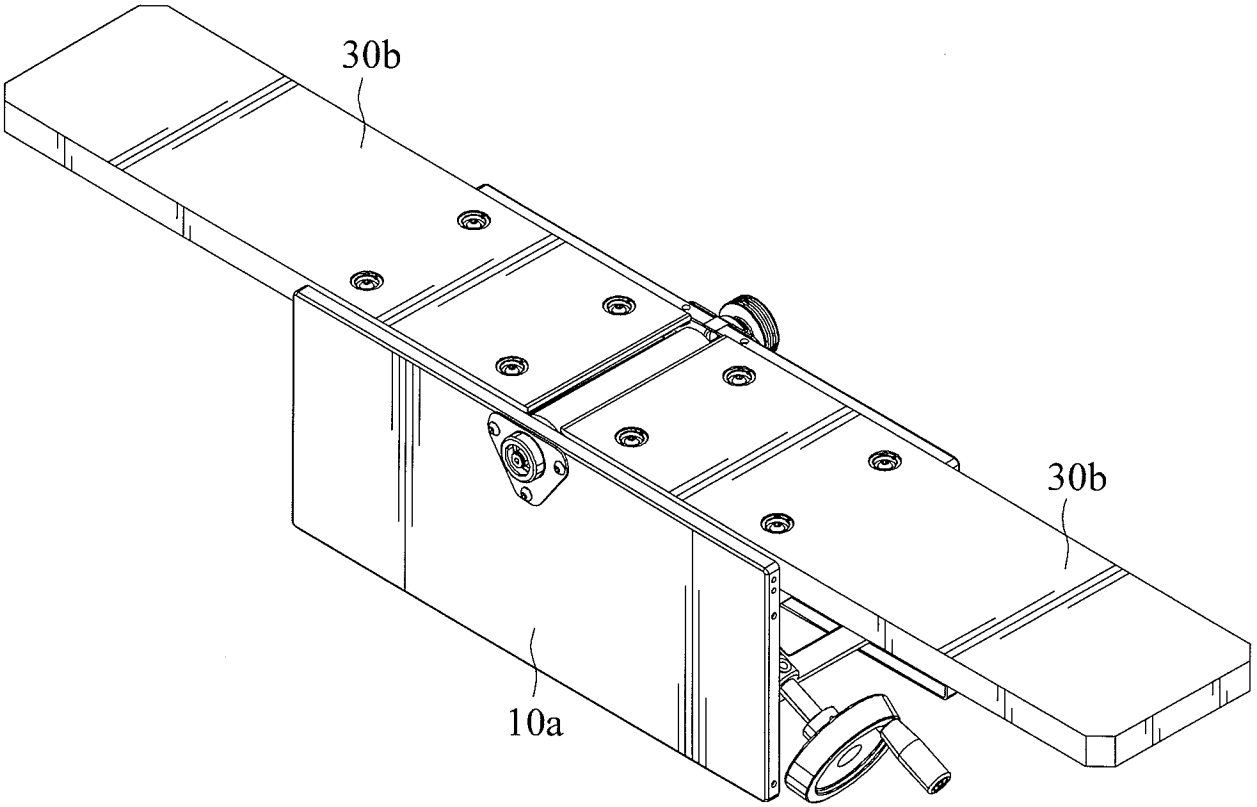
FIG. 16 is a perspective view of a level adjusting device and worktables in accordance with a third embodiment of the present invention.
Figure 17:
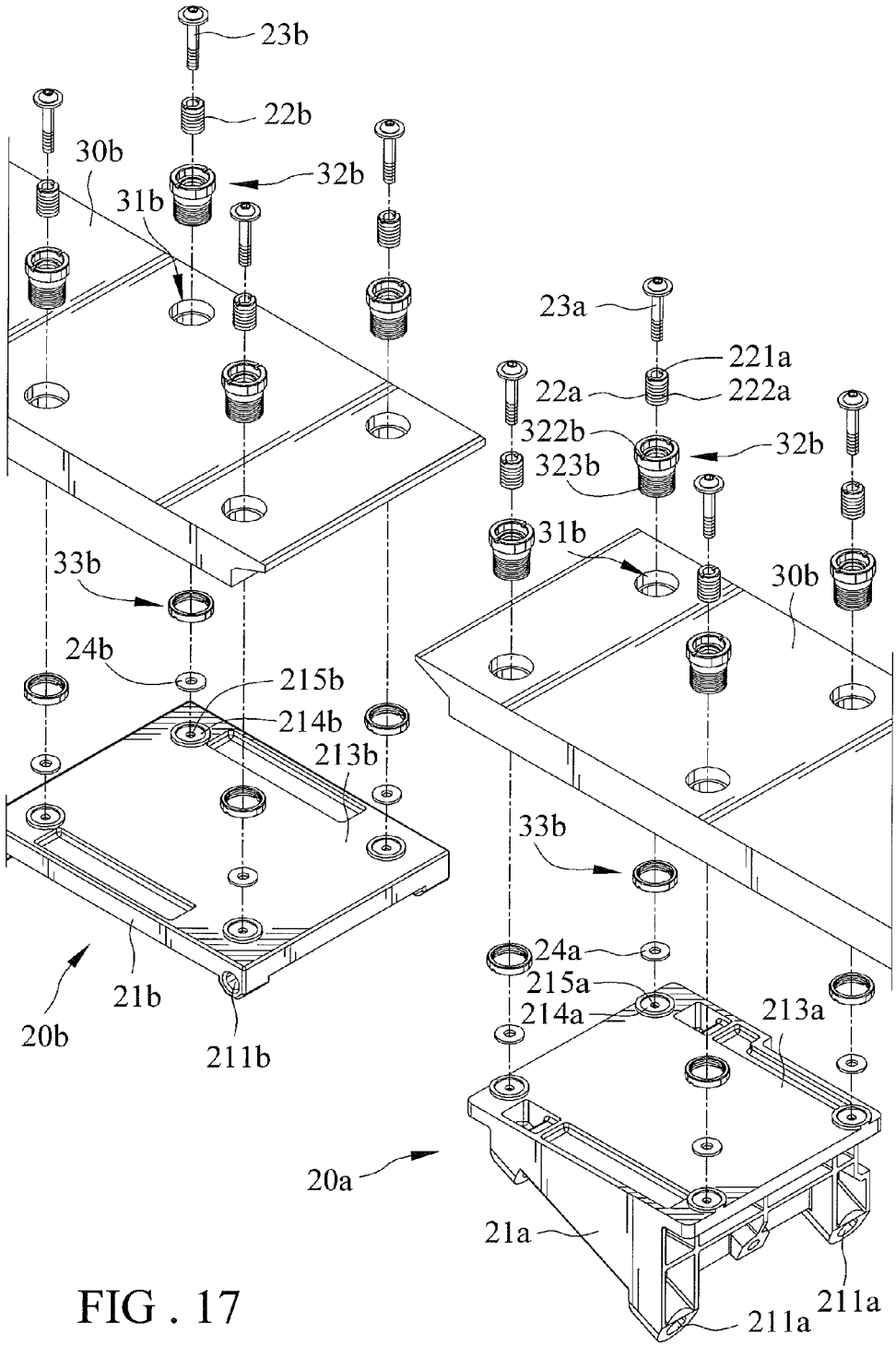
FIG. 17 is an exploded perspective view of the level adjusting device and the worktables of FIG. 16.
Figure 18:
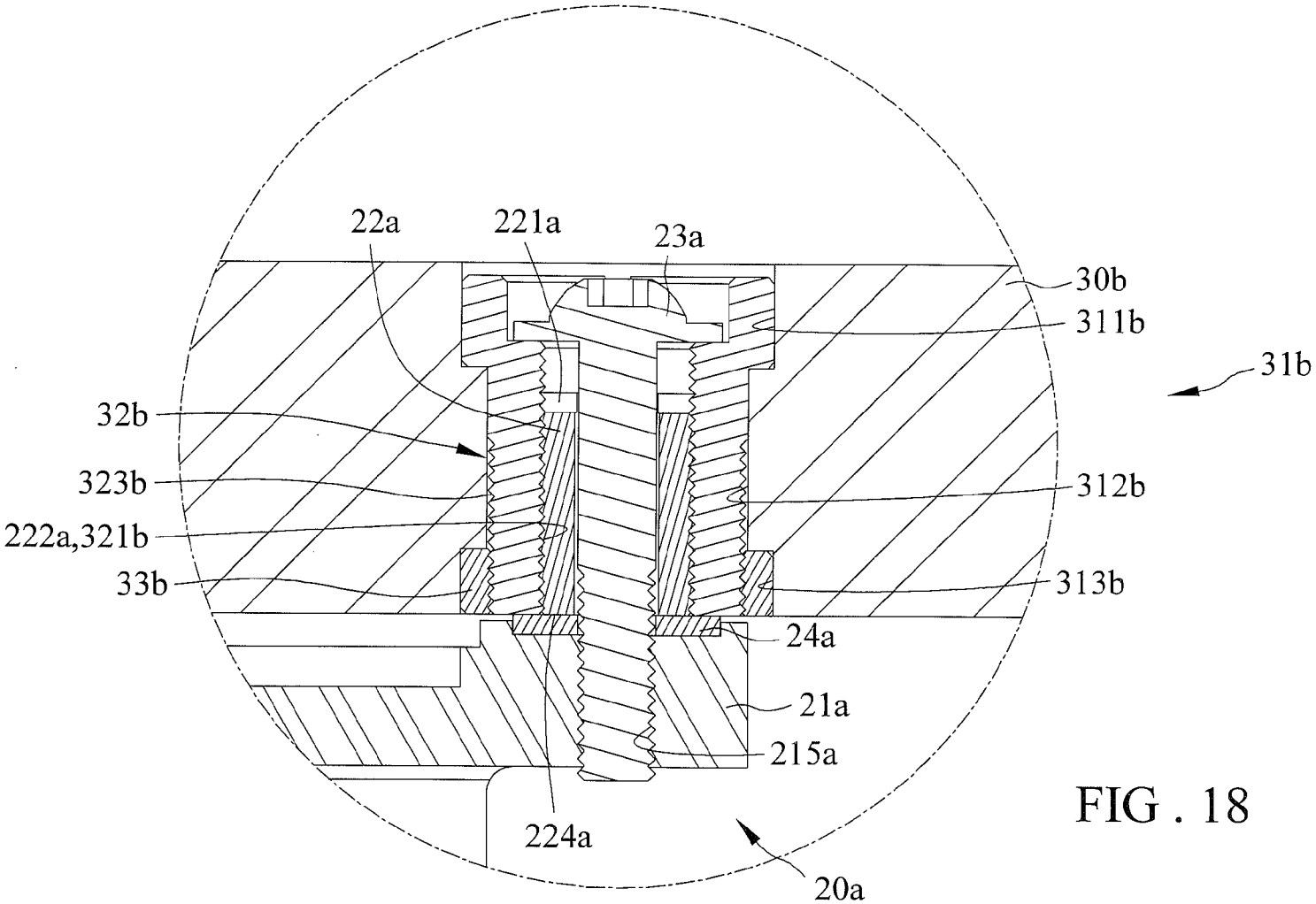
FIG. 18 is a cross-sectional view showing the worktable that is to be adjusted in a horizontal position.
Figure 19:
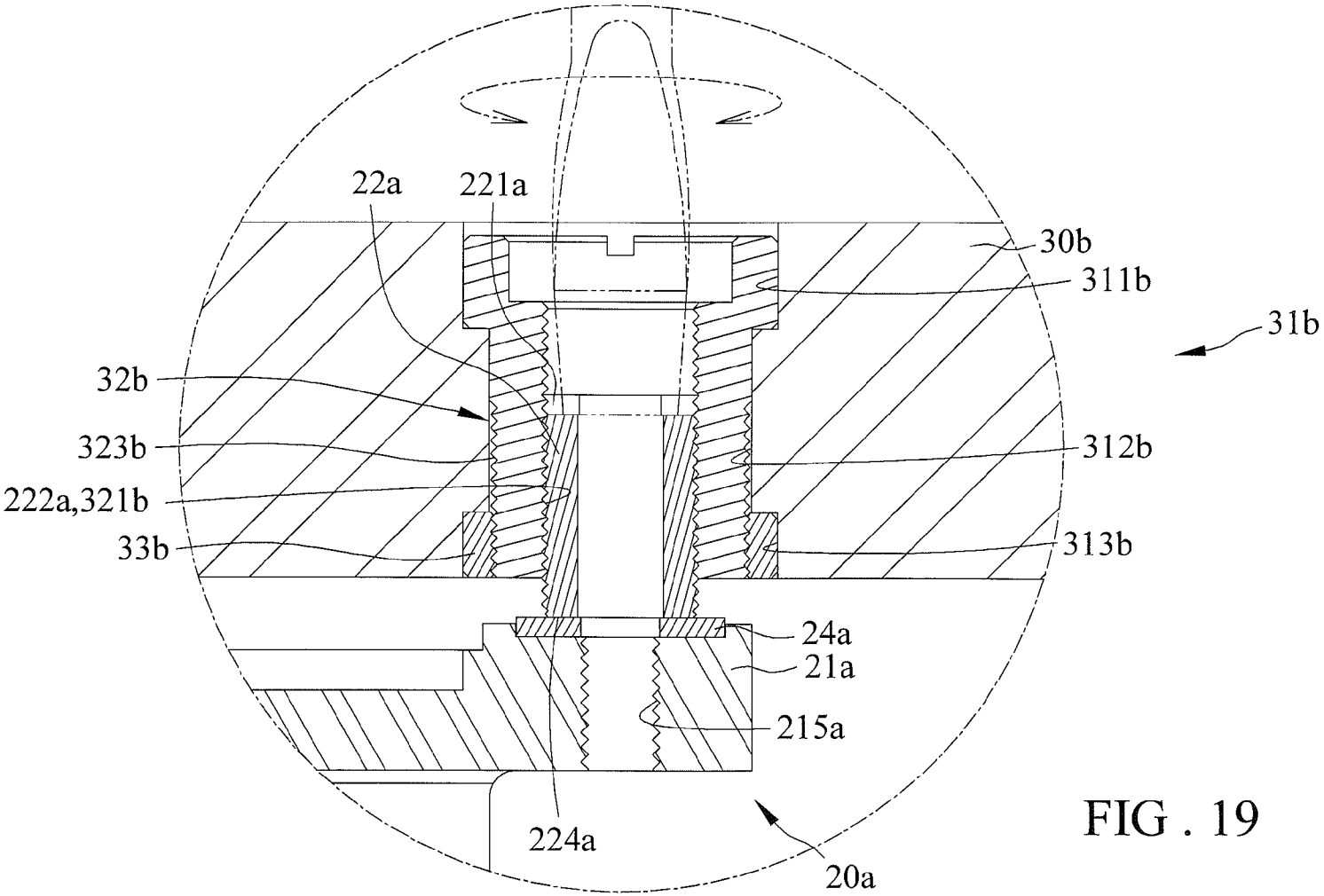
FIG. 19 is a continued cross-sectional view of FIG. 18 and shows the worktable undergoing a level adjustment operation and a tool for carrying out the adjustment, with the tool shown in phantom.
Figure 20:
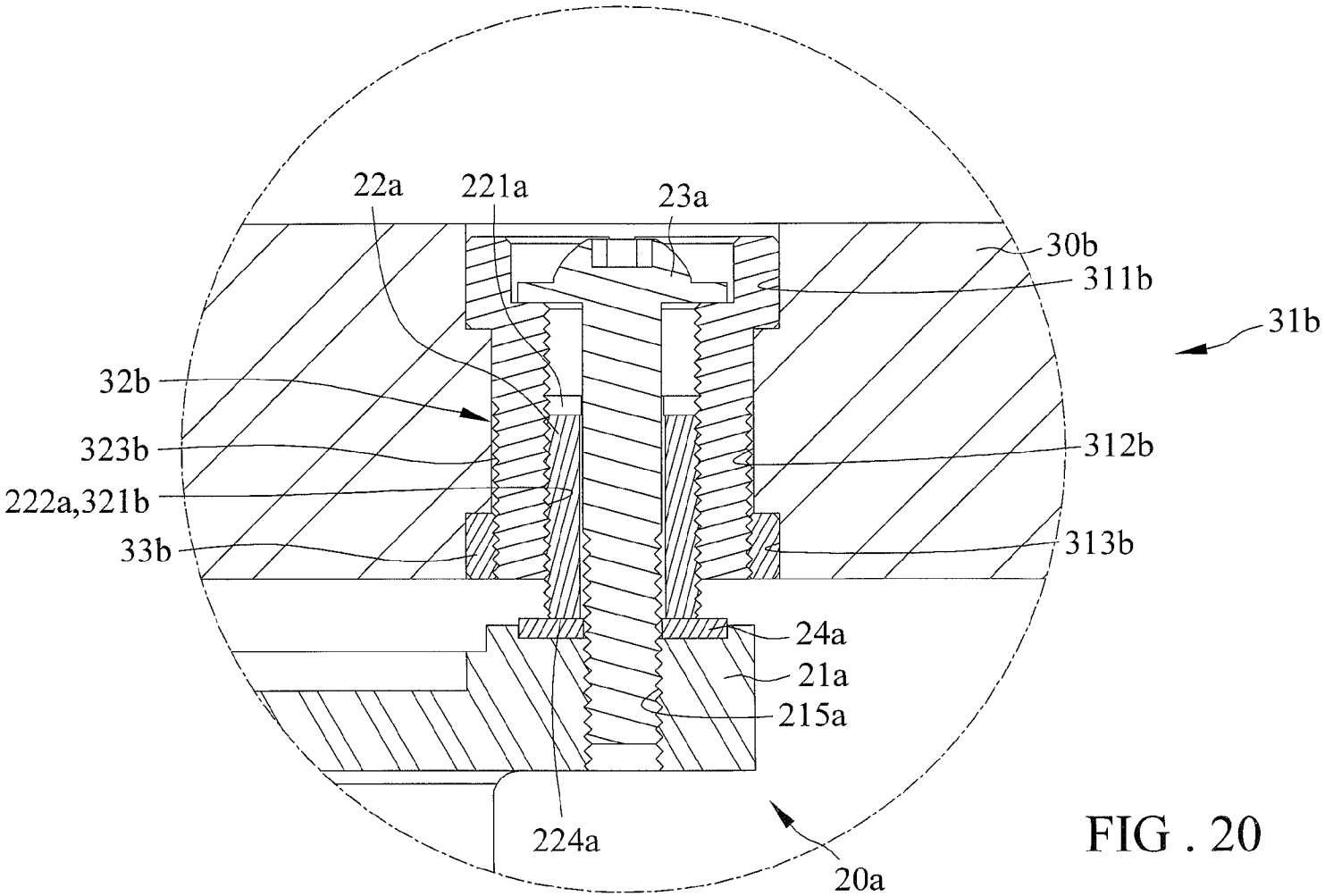
FIG. 20 is a continued cross-sectional view of FIG. 18 and shows the worktable adjusted to another horizontal position different than that of FIG. 18.

FIGS. 16 through 20 show a level adjusting device and worktables in accordance with a third embodiment of the present invention, wherein the same numerals are employed to denote the same parts previously shown and described, and wherein the third embodiment differentiate from the second embodiment in that the two adjustable worktables 30*a* are replaced with two adjustable worktables 30*b*. Each adjustable worktable 30*b* is made of granite and includes a plurality of receptacles 31*b* defined therein. Each receptacle 31*b* includes a smooth inner periphery and defines a first segment 311*b*, a second segment 312*b*, and a third segment 313*b*, and the second segment 312*b* is disposed between the first and third segments 311*b* and 313*b* and has a diameter smaller than diameters of the first and third segments 311*b* and 313*b*. Furthermore, each receptacle 31*b* includes a retaining structure 32*b* and an anti-disengagement structure 33*b* engaged therein, and the retaining structure 32*b* is engaged with the anti-disengagement structure 33*b* so as to be retained in the receptacle 31*b* and includes a hole 321*b* defined therein, a first section 322*b* to be engaged with a tool that facilitates an engagement of the retaining structure 32*b* with the anti-disengagement structure 33*b*, and a second section 323*b* extending from the first section 322*b* and engaging with the anti-disengagement structure 33*b*, and in addition, the anti-disengagement structure 33*b* is disposed in the third segment 313*b* of the receptacle 31*b*, and the first section 322*b* of the retaining structure 32*b* is received in the first segment 311*b* of the receptacle 31*b*, and the second section 323*b* of the retaining structure 32*b* is partly received in the second segment 312*b* and partly received in the third segment 313*b* of the receptacle 31*b*. The second section 323*b* of each retaining structure 32*b* has an outer periphery and the anti-engagement structure 33*b* engaged therewith has an inner periphery in thread engagement with the outer periphery of the retaining structure 32*b*. Also, each retaining structure 32*b* does not extend out of the third segment 313*b* of the receptacle 31*b* engaged therein. In this regard, the first adjusting device 20*a* is engaged with one adjustable worktable 30*b* and is adjusted to level the engaged adjustable worktable 30*b* with the other adjustable worktable 30*a*, that is, the adjustable worktable 30*b* is adjusted by adjusting the adjustors 22*a* with respect to the retaining structures 32*b* engaged therewith, and the adjustable worktable 30*a* is moved by the adjustors 22*a*.

In view of the forgoing, the adjustable worktable 30, 30*a*, 30*b* that the adjusting device 20, 20*a*, and 30*a* engage therewith is adapted to be precisely fine-leveled with either the fixed worktable 50 or another adjustable worktables 30*a* and 30*b* connected therewith by the adjusting device 20, 20*a*, and 30*a*, and the adjusting device 20, 20*a*, and 30*a* is of a simple structure. Additionally, the adjustable worktables 30, 30*b*, and 50 are made of granite. Furthermore, the plurality of stopping structures 214, 41, 214*a*, and 214*b* can serve as reference points.

While the specific embodiments have been illustrated and described, numerous modifications come to mind without significantly departing from the spirit of invention and the scope of invention is only limited by the scope of accompanying claims.

What is claimed is:

1. A woodworking machine comprising: a base; an adjusting device engaged with the base and including a platform, a plurality of adjusters, and a plurality of fastening members, with the platform slidably engaged with the base, with the plurality of adjusters being adjustable, with the plurality of fastening members releasably inserted through the plurality of adjusters respectively; and an adjustable worktable engaged with the adjusting device and including a plurality of receptacles defined therein and a plurality of retaining structures disposed therein;

wherein the platform bears the adjustable worktable and the plurality of adjusters abutted against the adjustable worktable; and wherein the adjustable worktable is adjustably moved upon adjusting of the adjusters, and prior to adjusting each adjuster, the fastening member engaged therewith is removed.

2. The woodworking machine as claimed in claim 1, wherein the platform includes a plurality of apertures extending therein.

3. The woodworking machine as claimed in claim 2, wherein the platform of the adjusting device includes a plurality of stopping structures, with the plurality of stopping structures defined coaxially and in communication with the plurality of apertures respectively.

4. The woodworking machine as claimed in claim 1, wherein each adjuster includes a first section to be engaged with a tool for facilitating an adjustment of the adjuster, a second section extending from the first section, and a through hole receiving one fastening member, with the through hole extending through the first and second sections.

5. The woodworking machine as claimed in claim 2, wherein the plurality of adjusters are adjustably engaged in the plurality of apertures respectively.

6. The woodworking machine as claimed in claim 5, wherein the plurality of retaining structures are disposed in the plurality of receptacles respectively, and each retaining structure includes a hole defined therein, with the hole aligned with one aperture.

7. The woodworking machine as claimed in claim 6, wherein the plurality of adjusters are abutted against the plurality of retaining structures respectively, and the plurality of fastening members are engaged in the holes of the plurality of the retaining structures respectively.

8. The woodworking machine as claimed in claim 7, wherein the second section of each adjuster has an outer periphery engaged with an inner periphery of the aperture engaged therewith.

9. The woodworking machine as claimed in claim 8, wherein the second section of each adjuster is in thread engagement with the aperture engaged therewith.

10. The woodworking machine as claimed in claim 1, wherein each retaining structures is in the form of an orifice extending in the adjustable worktable and is disposed coaxially with one receptacle.

11. The woodworking machine as claimed in claim 10, wherein the plurality of fastening members are inserted in the plurality of receptacles of the adjustable worktable and the plurality of adjusters respectively, with the first section of each fastening member received in the receptacle, with the second section inserted through one of the adjuster and engaging in one of the plurality of apertures.

12. The woodworking machine as claimed in 11, wherein the second section of each fastening member is in thread engagement with the aperture engaged therein.

13. The woodworking machine as claimed in claim 1, wherein the adjustable worktable is made of granite.

14. The woodworking machine as claimed in claim 1 further comprising a fixed worktable the adjustable worktable is leveled with respect to.

15. The woodworking machine as claimed in claim 1, wherein the number of adjustable worktable is two, and the two adjustable tables are leveled with respect to each other.

16. The woodworking machine as claimed in claim 1, wherein the adjustable worktable is made of cast iron.

17. The woodworking machine as claimed in claim 1 further comprising a cutter-mounting body mounted on the base and receiving a cutter that planes a workpiece.

* * * * *